US006318456B1

(12) United States Patent
Brenner et al.

(10) Patent No.: US 6,318,456 B1
(45) Date of Patent: Nov. 20, 2001

(54) HEAT EXCHANGER OF THE CROSSCURRENT TYPE

(75) Inventors: Martin Brenner, Kieselbronn; Klaus Luz, Herrenberg; Herbert Damsohn, Aichwald; Conrad Pfender, Besigheim, all of (DE)

(73) Assignee: Behr GmbH & Co., Stuttgart (DE)

( * ) Notice: Subject to any disclaimer, the term of this patent is extended or adjusted under 35 U.S.C. 154(b) by 0 days.

(21) Appl. No.: 09/519,660

(22) Filed: Mar. 6, 2000

(30) Foreign Application Priority Data

Mar. 6, 1999 (DE) ..... 199 09 881

(51) Int. Cl.[7] ..... F28F 3/08

(52) U.S. Cl. ..... 165/167; 165/133; 165/DIG. 373

(58) Field of Search ..... 165/165, 166, 165/167, DIG. 373, 133, DIG. 366

(56) References Cited

U.S. PATENT DOCUMENTS

| | | | | |
|---|---|---|---|---|
| 3,783,090 | | 1/1974 | Anderson et al. | 161/166 |
| 4,407,359 | * | 10/1983 | Berger et al. | 165/167 |
| 5,114,776 | * | 5/1992 | Cesaroni | 165/166 |
| 5,512,250 | * | 4/1996 | Betta et al. | 165/167 |
| 5,638,899 | * | 6/1997 | Blomgren et al. | 165/166 |
| 5,718,286 | | 2/1998 | Damsohn et al. | 165/167 |
| 5,829,517 | * | 11/1998 | Schmid et al. | 165/167 |
| 5,911,273 | * | 6/1999 | Breanner et al. | 165/167 |
| 5,971,065 | * | 10/1999 | Bertilson et al. | 165/166 |
| 6,145,588 | * | 11/2000 | Martin et al. | 165/166 |

FOREIGN PATENT DOCUMENTS

| | | |
|---|---|---|
| 2 207 756 | 9/1972 | (DE) . |
| 2 250 222 | 4/1973 | (DE) . |
| 43 43 399 | 6/1995 | (DE) . |
| 195 28 117 | 2/1997 | (DE) . |
| 196 54 361 | 6/1998 | (DE) . |

* cited by examiner

*Primary Examiner*—Ira S. Lazarus
*Assistant Examiner*—Terrell McKinnon
(74) *Attorney, Agent, or Firm*—Foley & Lardner

(57) ABSTRACT

The invention relates to a heat exchanger of the crosscurrent type, through which at least two fluids flow, consisting of plates which are stacked one on the other between two cover plates and which are spaced from one another in regions and are in contact in regions, so that fluid paths are formed between them in a heat transfer region, and of inlet ducts and outlet ducts which are arranged laterally in duct regions and which are formed from inlet duct openings and outlet duct openings in the plates, at least one inlet duct and one outlet duct being fluidically connected to a group of fluid paths which are next but one. The object of the invention is to develop a heat exchanger of the type initially mentioned, in such a way that, while having at least the same operating reliability, it can be produced more efficiently and more cost-effectively and has a lower weight. In order to achieve this object, there is provision for the spacing of the plates to be carried out by means of shaped-out portions of the plates.

33 Claims, 9 Drawing Sheets

HEAT EXCHANGER OF THE CROSSCURRENT TYPE

BACKGROUND OF THE INVENTION

1. Field of the Invention

The invention relates to a heat exchanger of the crosscurrent type.

2. Description of the Related Art

Such a heat exchanger is known from DE-A 195 28 117. This heat exchanger consists of flow duct plates with flow duct openings and also connecting duct plates. The flow duct plates and connecting duct plates are stacked one above the other alternately, in such a way that there is no fluid connection between flow duct plates adjacent to the flow duct openings. In this case, the flow duct openings of the flow duct plates are designed in the form of elongately shaped cutouts which, in interaction with the closed connecting duct plates, form fluid paths. The height of the fluid paths results, in this case, from the thickness of the flow duct plates. A lower connecting duct plate, a flow duct plate and an upper connecting duct plate are necessary in order to form a respective fluid path.

SUMMARY OF THE INVENTION

One disadvantage of such a known heat exchanger is the relatively large number of individual parts. In each case, a lower connecting duct plate, a flow duct plate and an upper connecting duct plate are necessary in order to form a respective fluid path. This results in a comparatively high weight and a high material requirement. This material requirement is increased by the fact that the cutouts for the flow ducts are removed from the flow duct plates by means of separating production methods, thus causing a comparatively large amount of high-grade materials to be lost. Since three plates are required in order to form a fluid path, there is also a large number of assembly seams which must be sealed off reliably in a fluid tight manner during the production of the heat exchanger, in order to ensure sufficient operating reliability.

One object on which the invention is based is to provide a heat exchanger of the type initially mentioned, in such a way that the above mentioned disadvantages are avoided, so that, while having at least the same operating reliability, it can be produced more efficiently and more cost-effectively and has a lower weight.

In accomplishing the objects of the invention, there has been provided a heat exchanger of the crosscurrent type, through which at least two fluids flow, comprising; a plurality of pairs of plates that are stacked one on the other between two cover plates, the plates of each pair being spaced from one another in a first region and being in contact in a second region, so that fluid paths are formed between them in a heat transfer region; each pair of plates including inlet ducts and outlet ducts arranged laterally in duct regions and formed from inlet duct openings and outlet duct openings in the plates, at least one inlet duct and one outlet duct in a first pair of plates being fluidically connected to a group of fluid paths formed between a third pair of plates separated from the first pair of plates by a second pair of plates; wherein the spacing of the plates in each pair is achieved by means of shaped-out portions of the plates.

DETAILED DESCRIPTION OF THE PREFERRED EMBODIMENT

Figure 1:
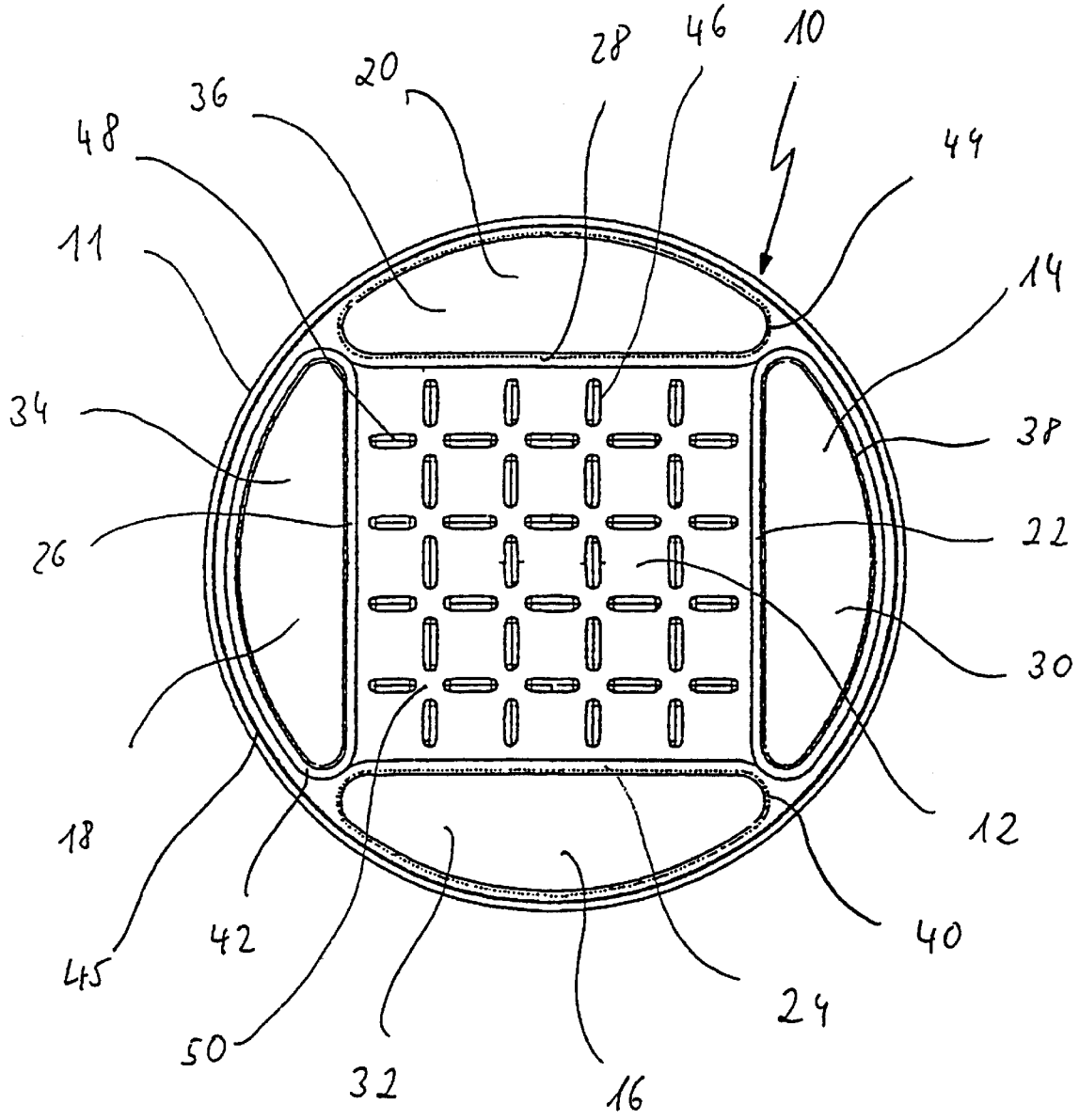
FIG. 1 is a top view of a plate of the heat exchanger designed according to the invention.

According to a preferred embodiment the invention, the spacing of the plates is effected by means of shaped-out portions of the plates. As a result, only two plates are required in order to form the respective fluid paths, since the spacing of the plates is not accomplished by means of a third plate arranged between them and provided with cutouts. Instead, the spacing is accomplished by means of shaped-out portions of one or both plates, so that the plates are spaced merely by means of the shaped-out portions. Such a design of the heat exchanger greatly decreases the number of individual parts and clearly reduces the overall weight. The number of assembly seams to be sealed off between the individual plates likewise decreases due to the reduced number of plates. The complexity of the production methods is also reduced, since, in order to produce the shaped-out portions, there is a number of possible forming methods for sheet metal forming, as compared with separating methods, such as punching or milling, thus likewise reducing the production costs and clearly diminishing the losses of material.

In one embodiment of the invention, the shaped-out portions are formed by bosses and/or beads arranged in regions. In this case, the bosses serve primarily for the spacing of plates adjacent to one another, while the beads basically serve for both sealing off various regions within the heat exchanger and sealing off relative to the outside.

In a further embodiment of the invention, the fluid paths have a height of about 0.1 mm to 2 mm, with a width of about 3 to 20 mm, and the plates have a thickness of about 0.03 to 0.3 mm. There is an essential difference between these comparatively small dimensions of the heat exchanger and the prior art described above. Particularly when liquid fluids flow through the heat exchanger, the very fine ducts with their extremely small fluid path height ensure good and rapid heat transfer between the fluid and the plates. The small thickness of the plates, in turn, ensures good and rapid neat transfer, so that, in the case temperature differentials of the fluids, rapid heat transfer from the first-mentioned fluid to the fluid adjacent to it is ensured.

In a further embodiment of the invention, the plates are of the same type and are assembled with each plate rotated 90° relative to the adjacent plate. It thereby becomes possible to produce a heat exchanger of this kind by simple means and with low tool costs, using a single type of plate. These plates are merely handled differently during the mounting operation, in that they are mounted by rotating one relative to another.

In a further embodiment of the invention, the bosses and/or beads are raised partially on different sides of the respective plate. Bosses and beads attached on two sides in this way afford the possibility, with relatively low degrees of forming of the shaped-out bosses and beads, of achieving fluid path heights which are twice as large as the individual shaped-out bosses and beads, when two bosses or beads are located opposite one another and are in contact.

In a further embodiment of the invention, the plates have boss rows in the heat transfer region, individual bosses being placed on a common boss axis, so that the boss rows consist of a plurality of successive bosses and of unformed regions arranged between them. This systematic arrangement of the bosses makes it possible to place the bosses closely adjacent to one another and, moreover, at the same time to leave regions in which the fluid can flow so as to be free of disturbances.

In a further embodiment of the invention, the bosses have an approximately oval shape. Particularly when the bosses are oriented with their smaller end face in the flow direction, such a shape affords advantages in terms of possible pressure drops.

In a further embodiment of the invention, a plurality of boss rows are arranged on the plates so as to be parallel to one another and parallel to the flow direction of the respective fluid. This affords advantages in terms of the pressure stability of the heat exchanger, since the more bosses there are, the greater the pressure stability of the heat exchanger can be. The arrangement of these bosses in parallel rows ensures high pressure stability along with low flow resistance.

In a further embodiment of the invention, a plurality of boss rows are arranged on the plates so as to be parallel to one another and perpendicular to the flow direction of the respective fluid. This systematically arranged increase in the density of the bosses further increases pressure stability, without excessive increase in the flow resistances.

In a further embodiment of the invention, the boss rows placed parallel to the flow direction of the respective fluid path project from the two plates, delimiting the respective fluid path into the respective fluid path, and are in mutual contact. The spacing between the bosses and beads is selected, in this case, in such a way that, despite the very thin plates, the necessary pressure stability of the heat exchanger is ensured.

In a further embodiment of the invention, a plurality of fluid path beads are arranged on the plates so as to be parallel to one another and parallel to the flow direction of the respective fluid. These beads are provided alternately to the boss rows used parallel to the flow direction and further increase the contact surface between the plates touching one another and, consequently, the pressure stability and also cause less turbulence in the respective fluid flow, as compared with the individually arranged bosses.

In a further embodiment of the invention, the boss rows placed perpendicularly to the flow direction of the respective fluid path project away from the respective fluid path from the two plates delimiting the respective fluid path. These boss rows thus perform the function, in the fluid path which is adjacent, of boss rows which are placed parallel to the flow direction.

In a further embodiment of the invention, the inlet duct openings and outlet duct openings have a plurality of individual opening regions which are separated from one another by means of separating webs. As a result of these separating webs, which have less of a fluidic function than a stability function, the regions of the inlet duct openings and outlet duct openings acquire greater pressure stability.

In a further embodiment of the invention, the inlet duct openings and outlet duct openings are bordered by duct beads. These ensure that the inlet and outlet ducts are sealed off, specifically both in relation to the outer skin and within the heat exchanger. The duct beads of the inlet openings and outlet openings located opposite one another are raised on a different side of the respective plate from the duct beads of the other inlet openings and outlet openings which are likewise located opposite one another. Therefore, during the 90° rotation carried out during the mounting operation, a connection and a seal are alternately provided between the respective fluid duct and the inlet or outlet duct.

In a further embodiment of the invention, the heat transfer region has an approximately square shape, and the duct regions have an approximately square circumferential edge. It is thereby possible for the duct regions to be designed in the same size over the entire inflow and outflow surface of the fluid ducts, so that the flows are as uniform as possible. Alternatively, the heat transfer region may have an approximately square shape, and the duct regions have an approximately circular circumferential edge, so that the inlet openings and outlet openings have an approximately semioval cross-sectional shape. Although the above mentioned advantages of a uniform flow cannot be fully achieved thereby, the heat exchanger, instead, has an increased degree of compactness in terms of its outer dimensions.

In a further embodiment of the invention, deep-drawn turbulators are integrated into the plates. These may be designed in the form of winglets. These turbulators cause an intensification of the turbulence of the duct flow and, consequently, an improvement in the heat transfer. At the same time, the turbulators can project into the respective fluid paths over a turbulator height which is smaller than the fluid path height of the respective fluid path, thus entailing further intensification of the turbulence.

In a further embodiment of the invention, the pair of plates which are located one pair away are spaced in order to receive corrugated fins, by means of corrugated-fin bosses which are higher than the other bosses. In this regard, the corrugated-fin bosses have a boss height of 0.5 mm to 4 mm and project alternately on both sides of the respective plate. When these plates are stacked, they are mutually supported via the bosses or beads, so that interspaces having a height of 1 mm to 8 mm are obtained. Furthermore, the corrugated fins have cutouts which are designed to match the arrangement of the corrugated-fin bosses, in such a way that the corrugated-fin bosses are in contact through these cutouts and therefore through the corrugated fins. In order to produce these corrugated fins, the corrugated-fin sheets are provided with boss cutouts prior to corrugating and subsequently the corrugated structure is introduced into the corrugated-fin sheets.

In a further embodiment of the invention, the plates consist of aluminum, copper or high-grade steel and are connected by soldering or brazing. Alternatively, they may also be connected by welding, preferably by means of diode lasers, with the welding head having the shape of the weld seam.

In a further embodiment of the invention, the plate consist of plastic and are connected by adhesive bonding.

In a further embodiment of the invention, the heat exchanger is braced mechanically, in that individual bosses or all the bosses of plates adjacent to one another are welded together and act as ties. In a further embodiment of the invention, the corrugated fins consist of thoroughly oxidized aluminum.

In a further embodiment of the invention, a first group of fluid paths functions as reaction ducts and a second group of fluid paths functions as reaction ducts or as heat exchange ducts. The plates which form the reaction ducts are provided at least partially with a catalyst coating on their sides facing the reaction ducts. It thereby becomes possible to use the heat exchanger as a catalyst for chemical processes, with the catalytic action by the catalyst coating taking place in the first fluid path, and the heat supply or heat discharge required for the catalytic process taking place by means of the fluid of the second fluid path.

In a further embodiment of the invention, the catalyst coating is formed by micropore-generating anodic oxidation of the plates and the subsequent application of the catalyst material to the plates thus oxidized. This makes it possible to achieve a large specific reaction surface, while at the same time ensuring a small overall volume.

Exemplary embodiments of the invention are illustrated in the drawings and described in more detail below.

FIG. 1 shows a top view of a plate 10 of the heat exchanger designed according to the invention. This plate 10 consists of an aluminum sheet with a thickness of 0.15 mm, has a circular outer contour edge 11 and possesses, in its inner region, a heat transfer region 12 and duct regions 14, 16, 18 and 20 surrounding the latter. The heat transfer region 12 has a square base area, the duct regions 14, 16, 18 and 20 bearing on one of the sides 22, 24, 26, 28 of the heat transfer region 12. The duct regions 14, 16, 18 and 20 are subdivided into a first inlet duct opening 30 and a second inlet duct opening 32 and also a first outlet duct opening 34 and a second outlet duct opening 36. The first inlet duct opening 30 is bordered by a first inlet duct bead 38, and the second inlet duct opening 32 is bordered by a second inlet duct bead 40. Also, the first outlet duct opening 34 is bordered by a first outlet duct bead 42, and the second outlet duct opening 36 is bordered by a second outlet duct bead 44. These beads each have a height of 0.15 mm. The inlet and outlet duct openings 30, 32, 34, 36 have an approximately oval shape which is flattened on the side facing the heat transfer region 12. The entire plate 10 is bordered by a circumferential bead 45.

The heat transfer region 12 has elongately shaped bosses 46 and 48, each with a height of 0.15 mm. These are produced in exactly the same way as the duct beads by the forming of the sheet metal of the plate 10. Five of these bosses are arranged on a common boss row axis running parallel to the boss longitudinal axes and thus form a boss row, which consists of individual bosses and of unformed regions arranged between them. Four of these boss rows are arranged parallel to one another and run with their boss row axis between the first inlet duct opening 30 and the first outlet duct opening 34, with the result that five parallel flow ducts, which are placed between the boss rows and are delimited laterally thereby, connect the first inlet duct opening 30 and the first outlet duct opening 34. At the same time, the flow ducts are not separated from one another in a fluid-tight manner on account of the unformed regions between the bosses within a respective boss row. Perpendicularly to these first rows of bosses 46 run further second rows of bosses 48, which run with their boss row axis between the second inlet duct opening 32 and the second outlet duct opening 36, with the result that five parallel flow ducts connect the second inlet duct opening 32 and the second outlet duct opening 36. The intersection regions 50 between the boss rows are arranged where the unformed regions placed between the bosses are located.

Figure 2:
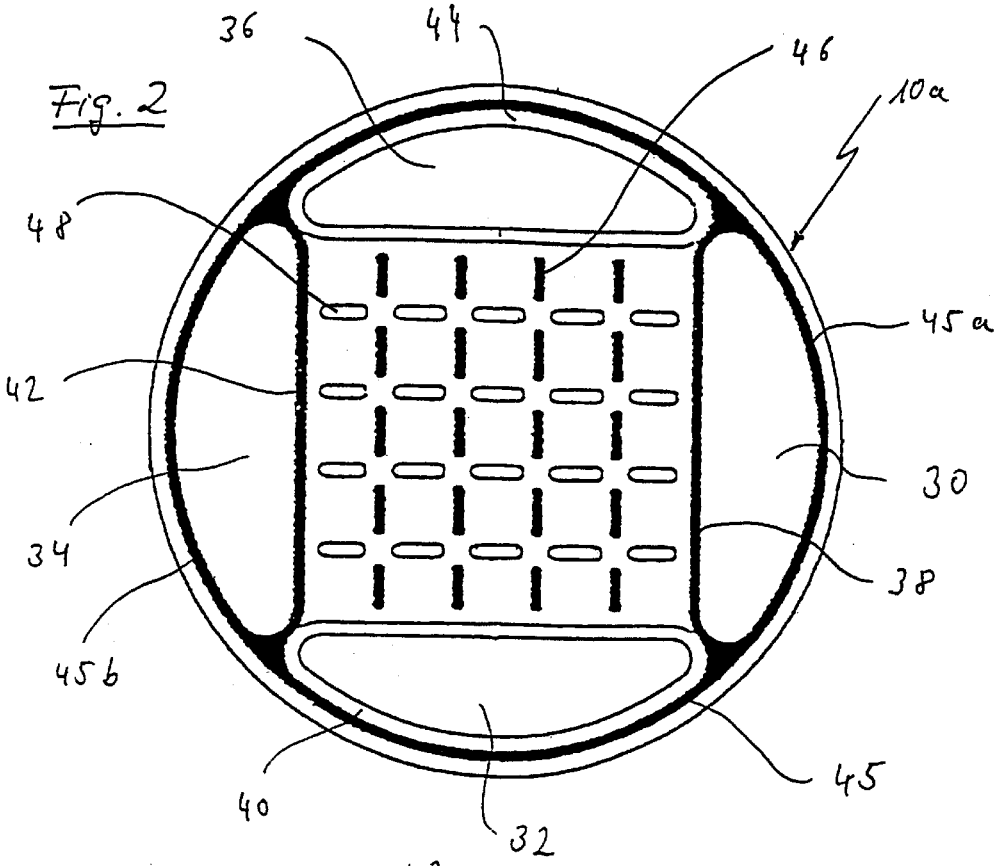
FIG. 2 is a top view of a plate of the heat exchanger designed the invention, with the direction of the shaped-out portions being illustrated.
Figure 3:
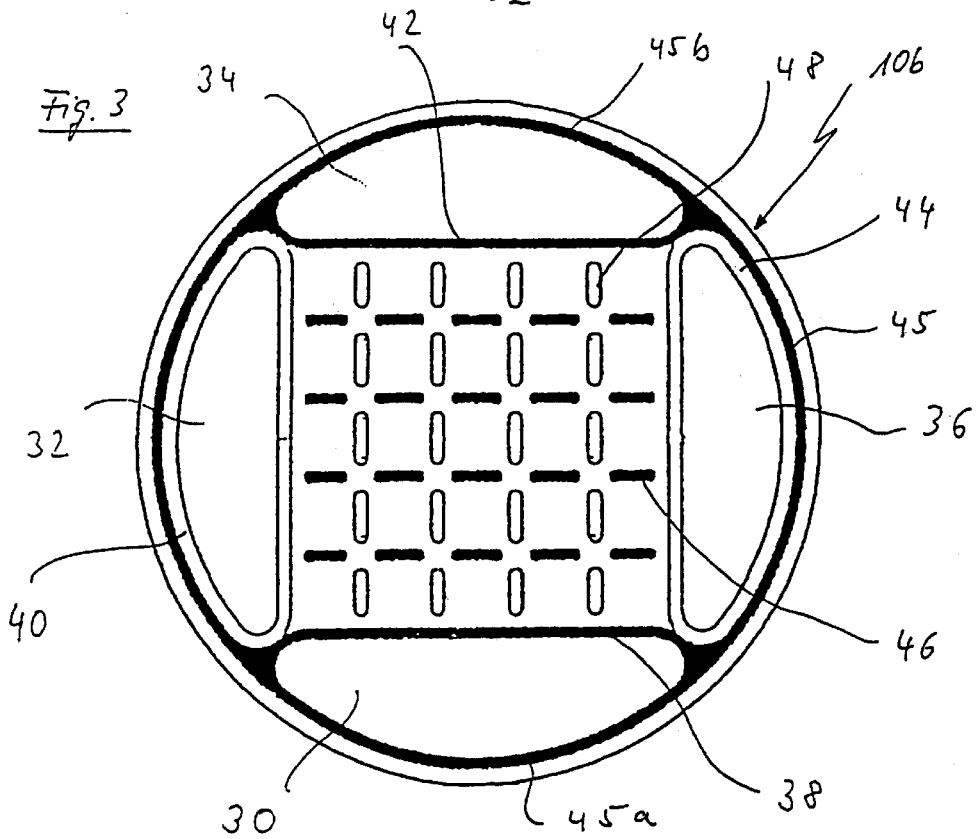
FIG. 3 is a top view of a plate of the heat exchanger designed according to the invention, with the direction of the shaped-out portions, which is rotated through 90° in relation to FIG. 2, being illustrated.

The directions of the shaped-out portions of the beads 38, 40, 42, 44 and of the bosses 46 and 48 become apparent from FIG. 2 and FIG. 3. These show a top view of a plate of the heat exchanger designed according to the invention, the direction of the shaped-out portions being illustrated by the thickness of the lines. Here, the bosses 46 illustrated by thick lines are shaped out upwardly in relation to the drawing plane, while the bosses 48 are shaped out downwardly. The circumferential bead 45 is likewise shaped out upwardly. In a slight modification of the illustration in FIG. 1, in the regions 45*a* and 45*b* the circumferential bead 45 at the same time partially performs the function of the duct beads 38 and 42, thus leading to functional integration and simplification of the design of the plate 10.

The heat exchanger according to the invention is obtained by stacking a plurality of such plates one on the other. During assembly, the plates are rotated through 90° relative to one another, e.g., in the present example of FIG. 2 and FIG. 3 by clockwise rotation. When initially two plates 10*a* and 10*b* are stacked one on the other in this way, with the plate 10*b* being laid onto the plate 10*a*, the bosses 46 of the plate 10*a* which are shaped out upwardly in the drawing plane come into contact with the bosses 48 of the plate 10*b* which are shaped out downwardly in the drawing plane, and thus ensure a mutual spacing between the two plates. The same applies accordingly to the beads. Thus, the first inlet duct beads 38 of the plate 10*a* which are shaped out upwardly in the drawing plane come into mutual contact with the second outlet duct beads 44 of the plate 10*b* which are shaped out downwardly in the drawing plane.

It may be noted in this respect that, due to the rotation of the plates, the designations of the outlet duct beads and inlet duct beads no longer describe the function of the associated openings, but are to be understood merely in geometric terms, as illustrated in FIG. 1.

Due to the contact of the inlet duct beads 38 of the plate 10*a* and of the outlet duct beads 44 of the plate 10*b*, a duct is formed in the region in which the first inlet duct opening 30 of the plate 10*a* or the second outlet duct opening 36 of the plate 10*b* is placed, said duct being sealed off relative to the heat transfer region 12 by means of the two inlet duct beads 38 and outlet duct beads 44. The same applies to the duct in the opposite region in which the second inlet duct opening 32 of the plate 10*b* and the first outlet duct opening 34 of the plate 10*a* are placed. Due to this sealing off, the fluid guided via the heat transfer region 12 undergoes lateral guidance. Moreover, the heat transfer region is uncoupled fluidically relative to the two ducts mentioned above.

Since the second outlet duct beads 44 of the plate 10*a* are shaped out downwardly and the associated first outlet duct beads 42 of the plate 10*b* upwardly, that is they project away from the fluid path formed by the plates 10*a* and 10*b*, these beads are not in mutual contact. They consequently ensure fluidic contact between the ducts formed by these beads 42 and 44. The same applies accordingly to the second inlet duct beads 40 of the plate 10*a* and the first inlet duct beads 38 of the plate 10*b*. Since these beads 42 and 44 or 38 and 40 project away from the fluid path formed by the plates 10*a* and 10*b*, these beads project into the fluid paths in the plane which is adjacent and is formed by the stacking of further plates. These beads are in contact with the plate which is next.

Figure 5:
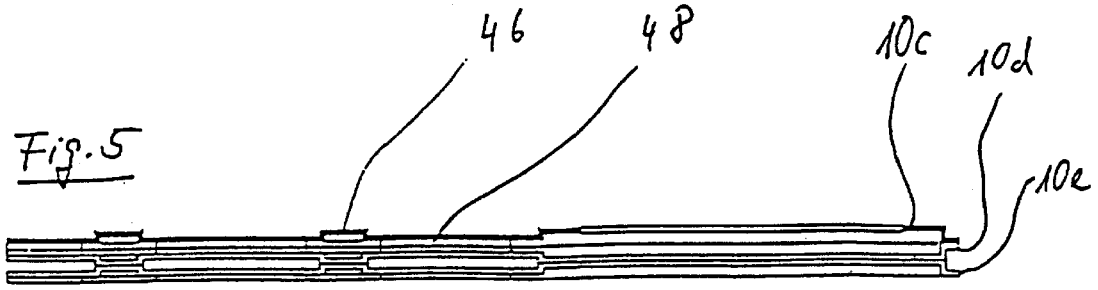
FIG. 5 is a sectional illustration along the line I—I of FIG. 4.
Figure 4:
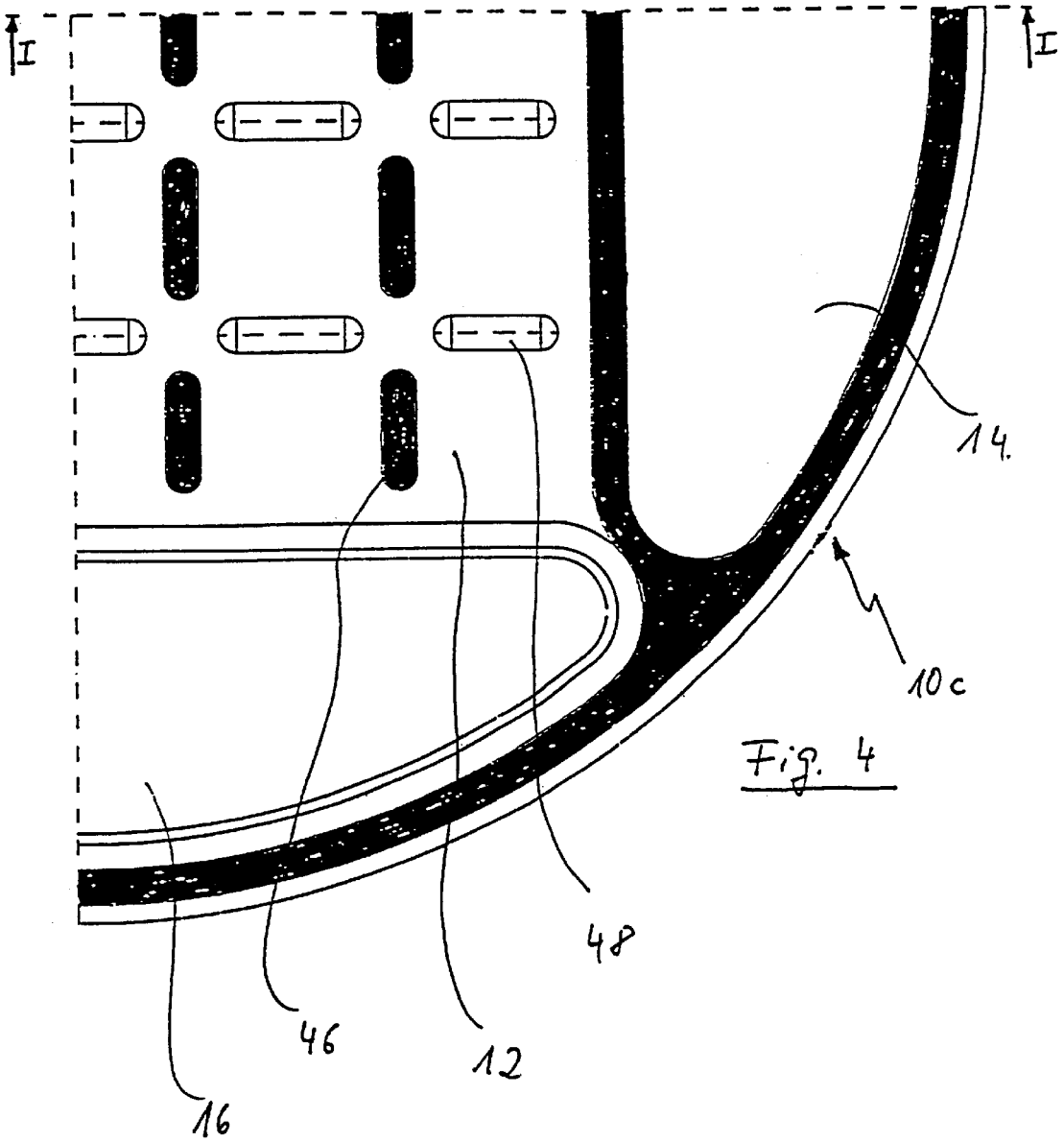
FIG. 4 is a top view of a part region of the plate from FIG. 2.

Further stacking of plates 10*c*, 10*d*, 10*e* one on the other according to FIG. 4 and FIG. 5 thus gives rise to a heat exchanger, including its four duct regions 14, 16, 18 and 20. Two duct regions located opposite one another are fluidically coupled in a first plane by means of the heat transfer region 12, and the other two ducts are separated. These other two ducts are fluidically coupled in the next adjacent plane next, whereas the first-mentioned two ducts are separated in this adjacent plane. This results in a heat exchanger that allows heat transfer between two fluids by the crosscurrent method.

Figure 6:
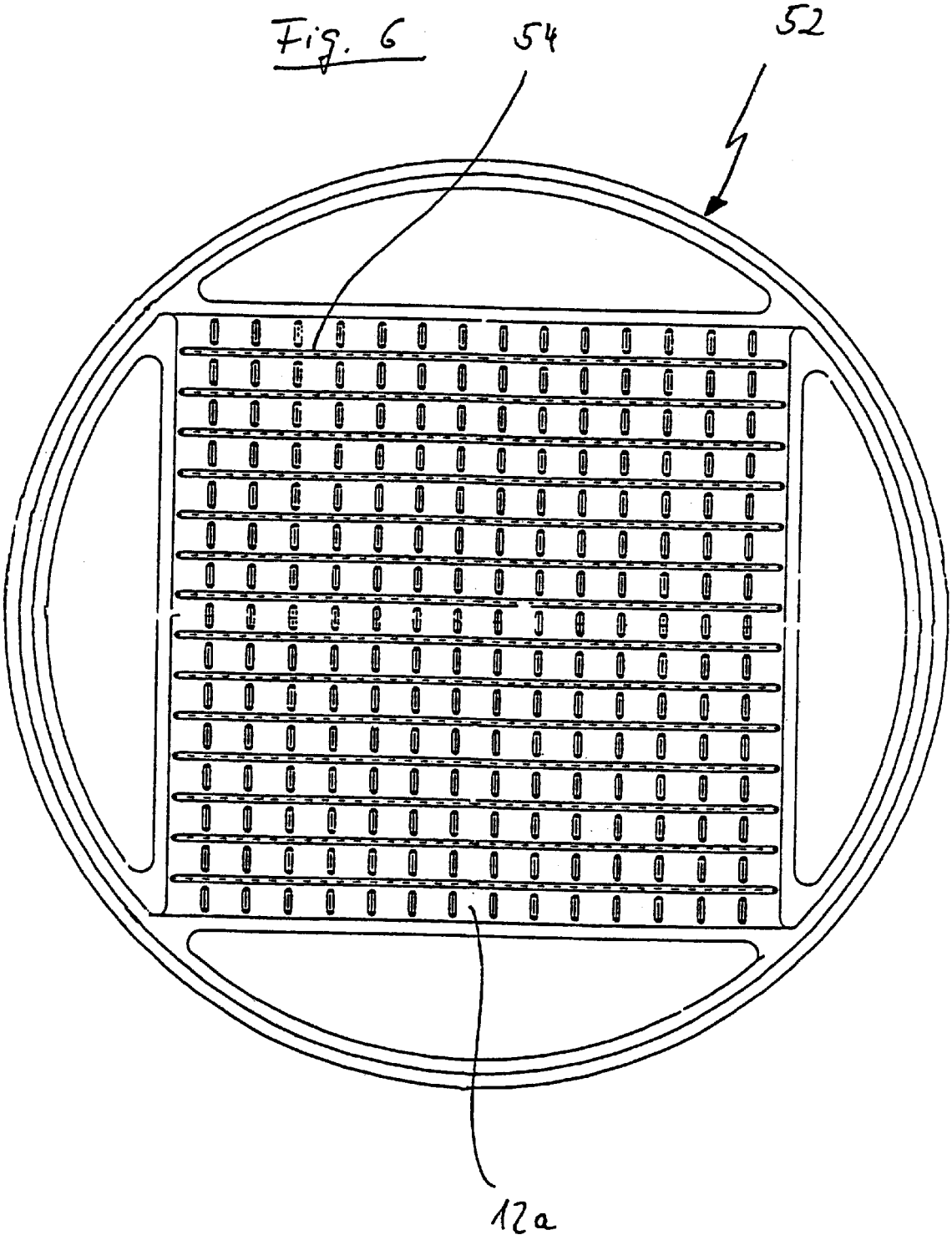
FIG. 6 is a top view of a plate, modified in relation to FIG. 1, of the heat exchanger according to the invention, with continuous fluid path beads.

FIG. 6 shows an alternative version of the plate 10 illustrated in FIG. 1. This plate 52, and the heat exchanger formed from it, correspond basically to the design illustrated in FIG. 1. It differs merely in the design of the heat transfer region 12*a*, in that continuous fluid path beads 54 are used on the plate 52 instead of the bosses 48 of the plate 10. As a result, the contact surface between the individual plates is increased, thus resulting in increased pressure stability. The above description of the first embodiment otherwise applies accordingly to this alternate embodiment heat exchanger.

Figure 7:
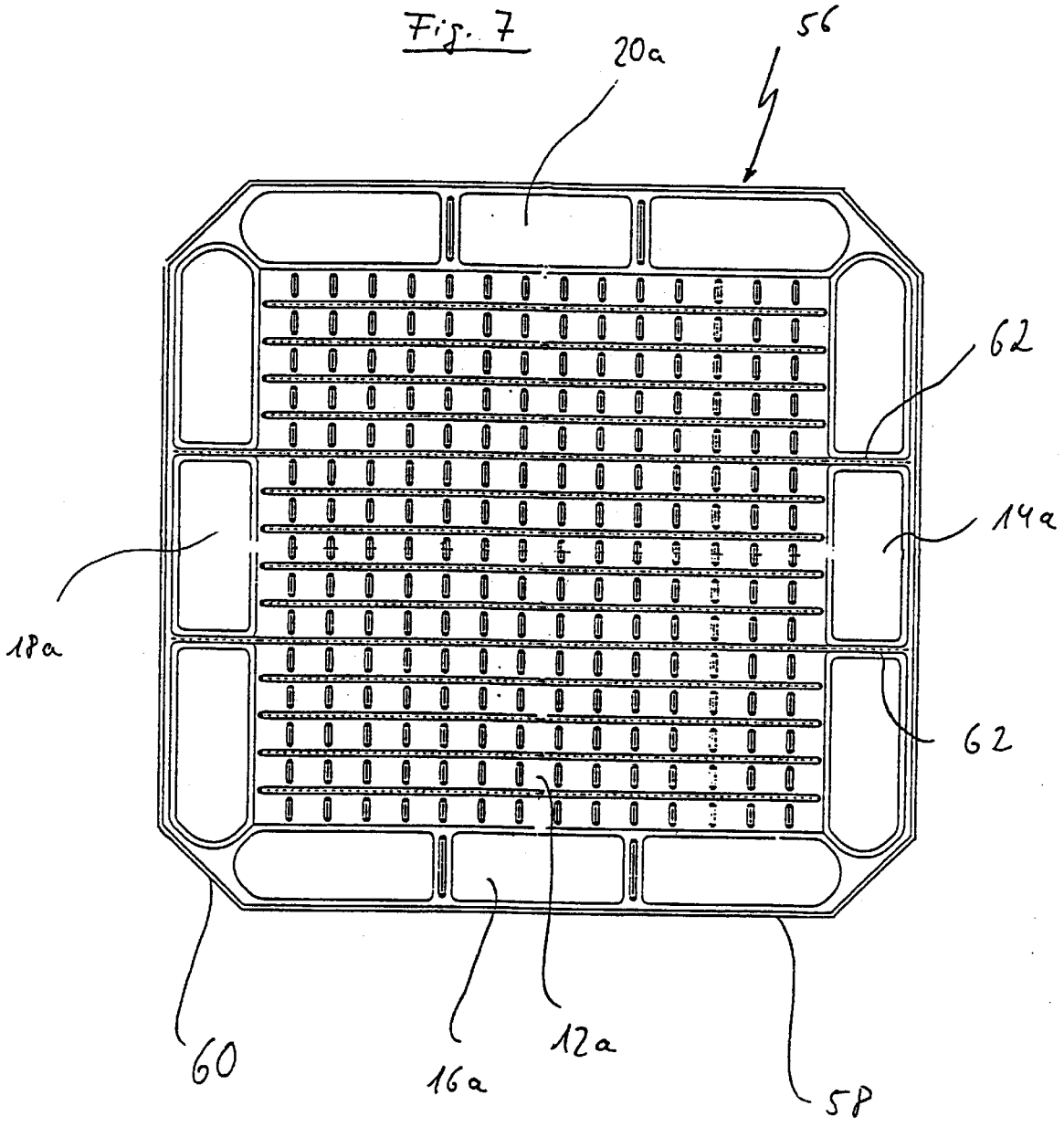
FIG. 7 is a top view of a plate, modified in relation to FIG. 6, of the heat exchanger according to the invention, with a square circumferential edge and separating webs in the opening regions.

FIG. 7 shows a plate 56 which is modified, as compared with FIG. 6, and in which the design of the heat transfer region 12*a* is identical to that of FIG. 6. Only the outer duct region 14*a*, 16*a*, 18*a*, 20*a* is changed. The latter possesses an approximately square circumferential edge 58 which has a chamferlike flattening 60 at each of the corners. In the duct region 14*a*, 16*a*, 18*a*, 20*a*, the opening regions placed on one of the four sides of the heat transfer region 12*a* are separated from one another by means of separating webs 62. The ducts formed from the individual opening regions when the plates 56 are stacked one on the other thereby acquire greater pressure stability.

Figure 8:
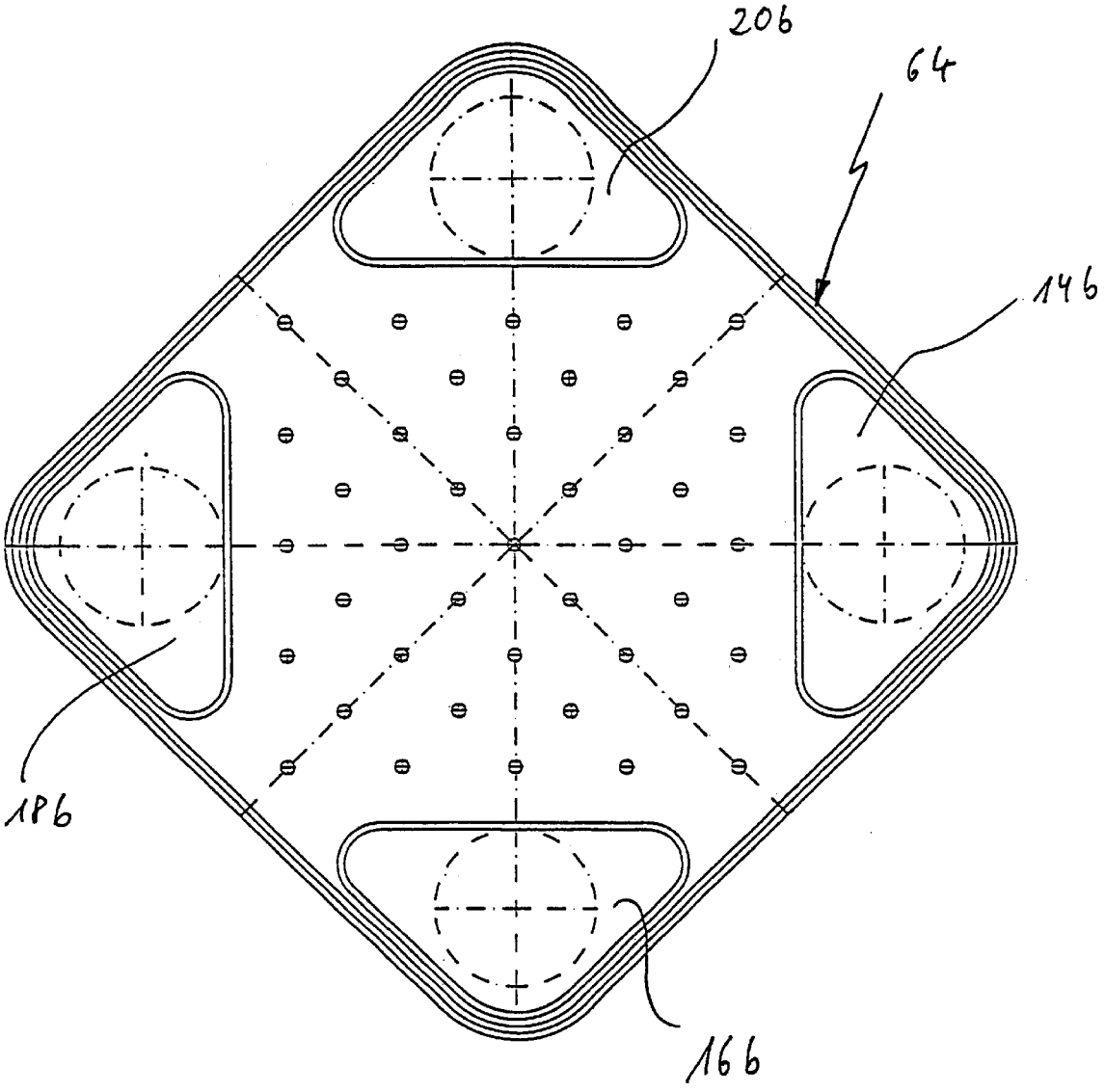
FIG. 8 is a view of a plate, modified in relation to FIG. 6, of the heat exchanger according to the invention, with a square circumferential edge and with ducts arranged in the corners.

Another possibility for arranging the duct regions 14*b*, 16*b*, 18*b*, 20*b* in a plate 64 is shown in FIG. 8. Here, the ducts each have an approximately triangular shape and are arranged in the corner regions of the plate 64 which, overall, is square. In contrast to the plate 10 from FIG. 1, the bosses 66 have a circular cross sectional shape. The above description otherwise applies to the rest of the design and to the mode of functioning for this embodiment.

Figure 10:
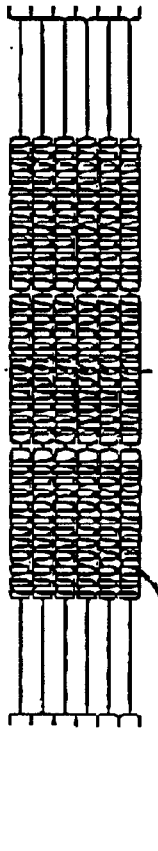
FIG. 10 is a sectional illustration along the line II—II of FIG. 9.
Figure 9:
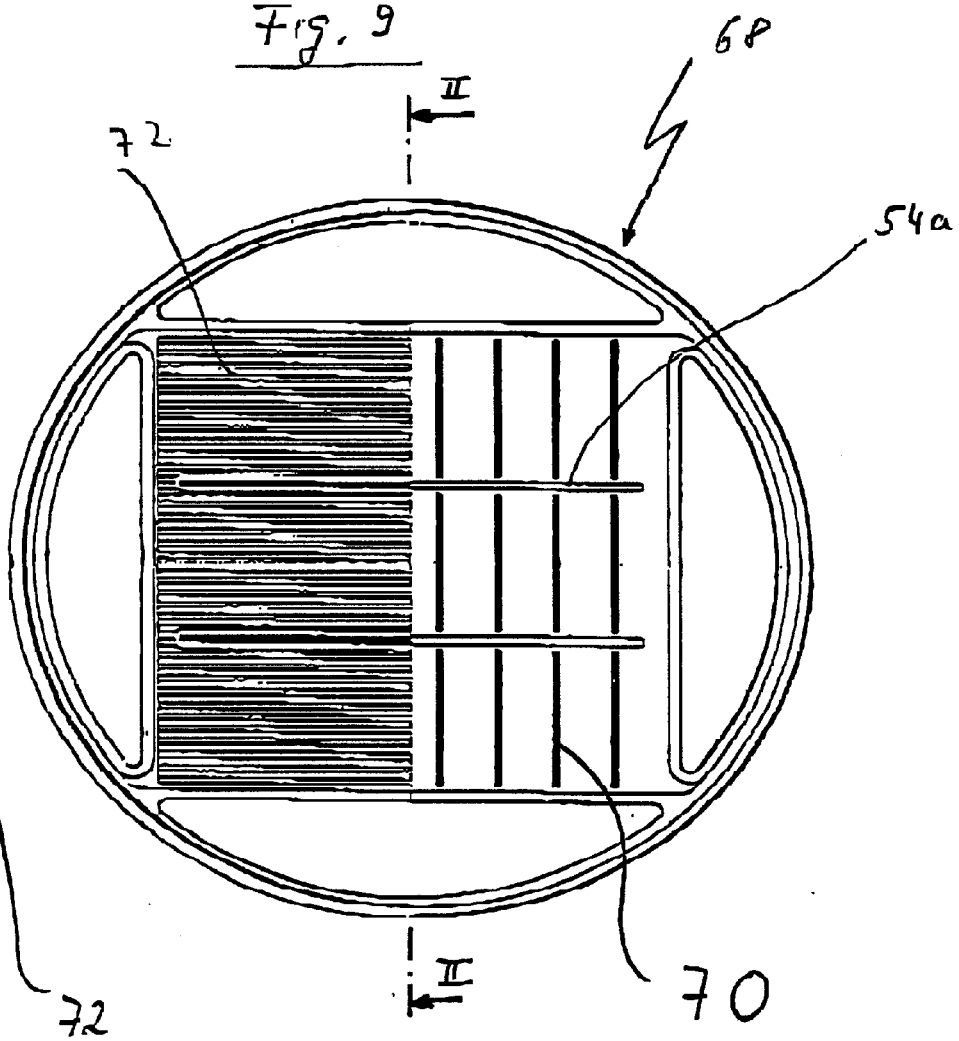
FIG. 9 is a top view of a plate with partially introduced corrugated fins.
Figure 11:
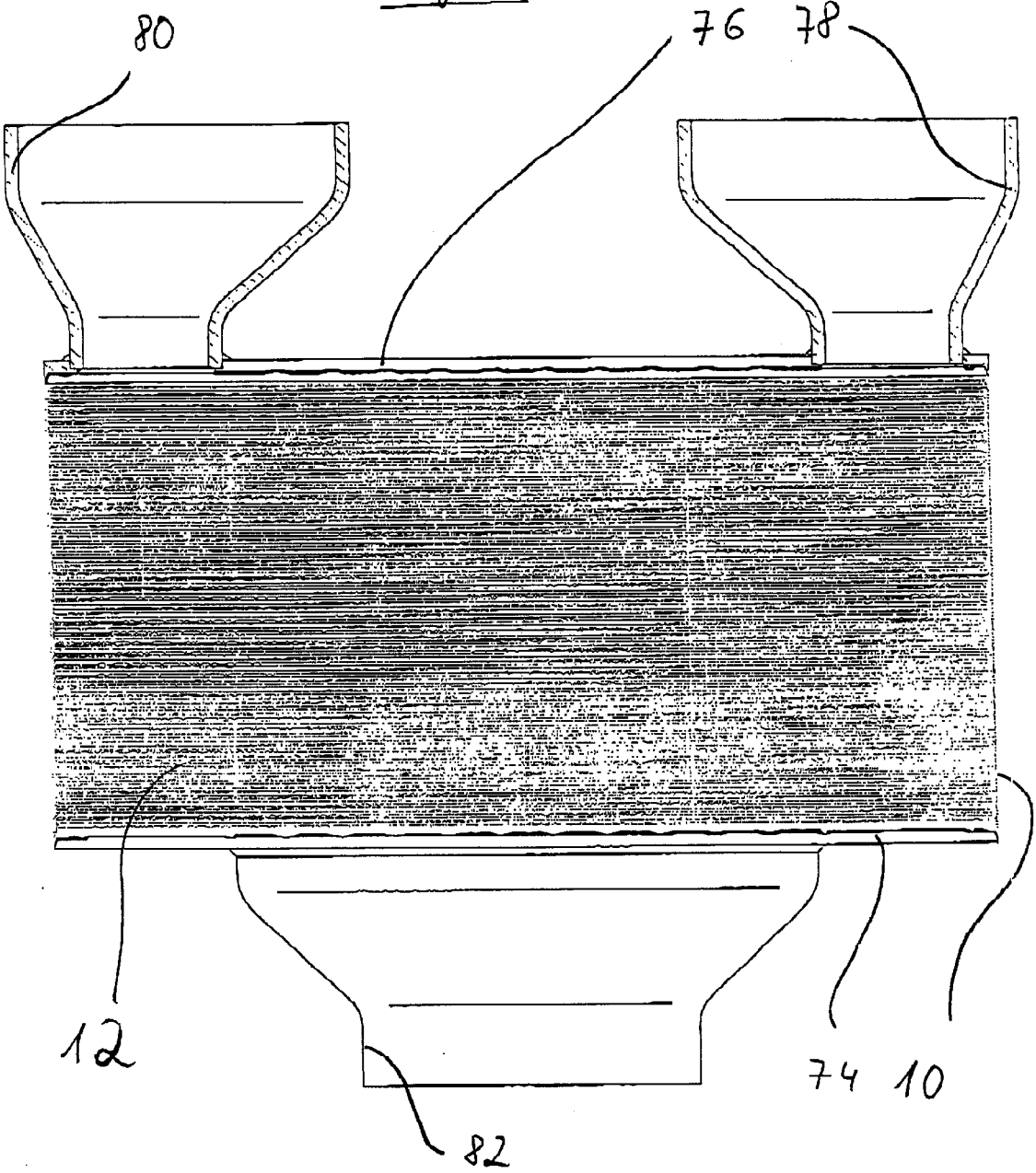
FIG. 11 is a side view of the entire heat exchanger.
Figure 12:
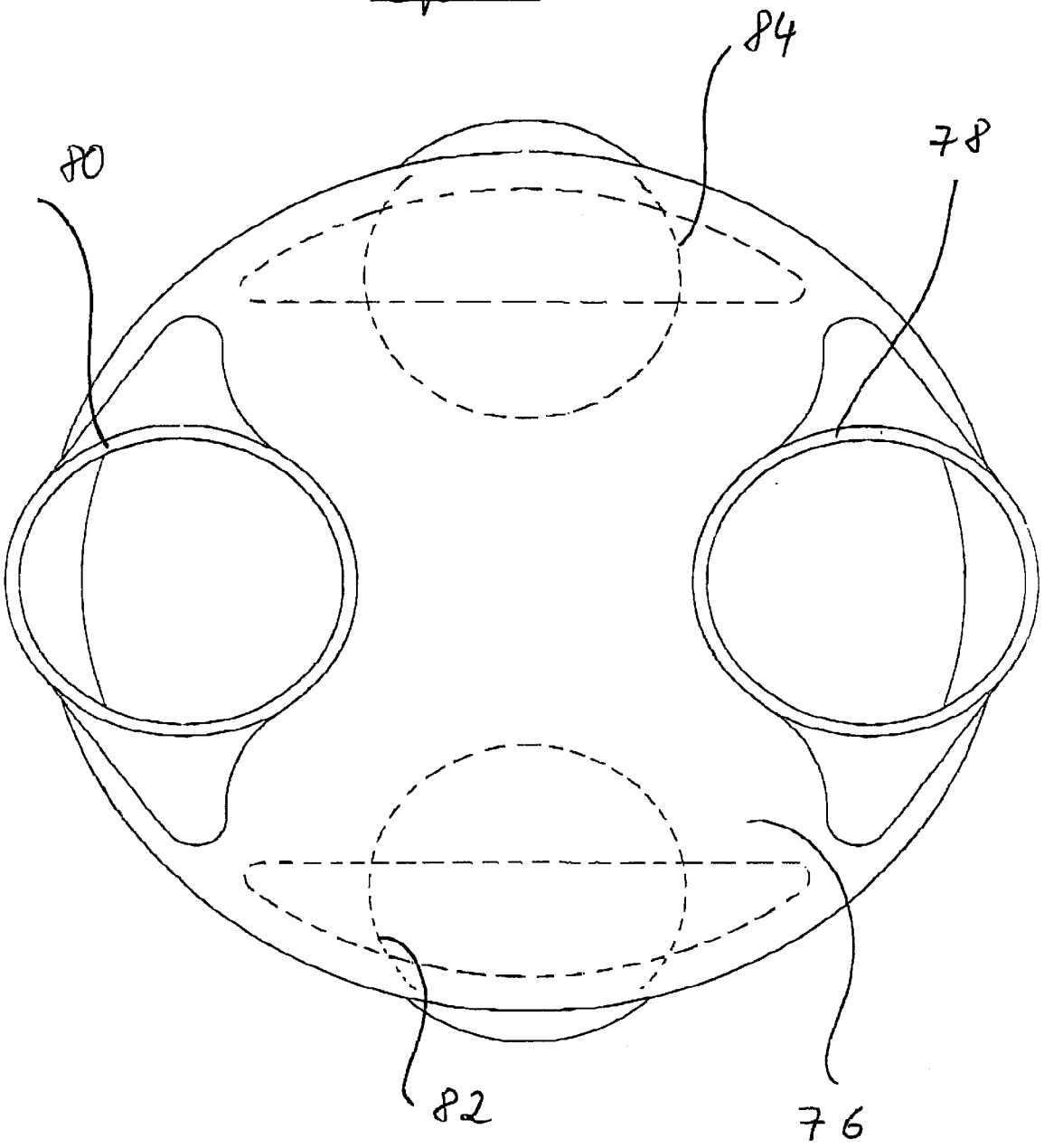
FIG. 12 is a top view of the heat exchanger.

FIG. 9 shows a top view of a plate 68 which initially corresponds basically to the design of the plate 52 from FIG. 6. The spacing of the fluid path beads 54*a* is modified here, so that the bosses originally arranged between them likewise have a more elongated shape and have become beads 70. However, the bosses or beads 70 are shaped out to a clearly greater height in direction of the plate 68 than in the other direction of the plate 68, so that the stacked heat exchanger, illustrated in section in FIG. 10, has, adjacent to one another, a very low fluid path with a height of about 0.15 mm and a relatively high fluid path with a height of about 2.0 mm. Corrugated fins 72 can be introduced into the high fluid paths. These have cutouts which are designed to match the beads 70. A heat exchanger designed in this way may be used, for example, as a condenser, in order to condense high-purity water out of moist air. In order to do so without such water taking up ions from the condenser material, it is necessary to have a version made of high-grade steel. This condenser is cooled by a second fluid, in this case by ambient air, and thus corrugated fins consisting of aluminum material are advantageous.

Other applications of the heat exchangers according to the invention include use in a gas generating system of a motor vehicle operated by fuel cells, wherein the heat exchanger is designed as a chemical reactor, such that every second fluid path is provided as a reaction duct with a catalyst coating, and the remaining fluid paths serve for cooling or heating the reaction ducts.

Use as a catalytic reactor, particularly in a high-grade steel version, is also possible. Since a large catalytically coated exchange surface is necessary in catalytic reactors of this type, this can be achieved by means of the corrugated-fin structure, using, for example, thoroughly oxidized aluminum, which is an outstanding carrier substance for catalysts. While the medium to be catalyzed flows through the carrier, the second fluid serves for controlling the temperature of the process.

Furthermore, use as an oil cooler or fuel cooler is also possible.

Connections 78, 80, 82, 84 to the heat exchangers are afforded by cover plates 74, 76, which delimit the respective plate stacks on each stack side and between which the respective plate stacks are arranged.

The entire content of German Patent Application No. 199 09 881.6 is hereby incorporated by reference.

It will be apparent to persons of ordinary skill in the art that other alternative embodiments are possible for realizing the present invention. It is intended to encompass and protect all such modifications and alternative embodiments by means of the appended claims.

We claim:

1. A heat exchanger of the crosscurrent type, through which at least two fluids flow, comprising;

a plurality of pairs of plates that are stacked one on the other between two cover plates, the plates of each pair being spaced from one another in a first region and being in contact in a second region, so that fluid paths are formed between them in a heat transfer region;

each pair of plates including inlet ducts and outlet ducts arranged laterally in duct regions and formed from inlet duct openings and outlet duct openings in the plates, at least one inlet duct and one outlet duct in a first pair of plates being fluidically connected to a group of fluid paths formed between a third pair of plates separated from the first pair of plates by a second pair of plates;

wherein the spacing of the plates in each pair is achieved by means of shaped-out portions of the plates; and wherein the fluid paths have a height of about 0.1 mm to 2 mm, with a width of about 3 to 20 mm, and the plates have a thickness of about 0.03 to 0.3 mm.

2. A heat exchanger as claimed in claim 1, wherein the shaped-out portions are formed by bosses and/or beads.

3. A heat exchanger as claimed in claim 1, wherein the plates are identical and are assembled by rotating through 90° relative to the adjacent plate.

4. A heat exchanger as claimed in claim 2, wherein the bosses and/or beads are raised partially on different sides of the respective plate.

5. A heat exchanger as claimed in claim 1, wherein the plates have boss rows in the heat transfer region, individual bosses being placed on a common boss axis, so that the boss rows comprises a plurality of successive bosses and of unformed regions arranged between the bosses.

6. A heat exchanger as claimed in claim 5, wherein the bosses have an approximately oval shape.

7. A heat exchanger as claimed in claim 1, wherein a plurality of boss rows are arranged on the plates so as to be parallel to one another and parallel to the flow direction of the fluid flowing in contact with the bosses.

8. A heat exchanger as claimed in claim 1, wherein a plurality of boss rows are arranged on the plates so as to be parallel to one another and perpendicular to the flow direction of the respective fluid.

9. A heat exchanger as claimed in claim 7, wherein the boss rows placed parallel to the flow direction of the respective fluid path project from two adjacent plates defining the respective fluid path and are in mutual contact.

10. A heat exchanger as claimed in claim 1, wherein a plurality of fluid path beads are arranged on the plates so as to be parallel to one another and parallel to the flow direction of the respective fluid.

11. A heat exchanger as claimed in claim 8, wherein the boss rows placed perpendicularly to the flow direction of the respective fluid path project away from the respective fluid path from the two plates defining the respective fluid path.

12. A heat exchanger as claimed in claim 1, wherein the inlet duct openings and outlet duct openings have a plurality of individual opening regions which are separated from one another by means of separating webs.

13. A heat exchanger as claimed in claim 1, wherein the inlet duct openings and outlet duct openings are bordered by duct beads.

14. A heat exchanger as claimed in claim 13, wherein the duct beads of the inlet openings and outlet openings located opposite one another are raised on a different side of the respective plate from the duct beads of the other inlet openings and outlet openings that are likewise located opposite one another.

15. A heat exchanger as claimed in claim 1, wherein the heat transfer region has an approximately square shape and the duct regions have an approximately square circumferential edge.

16. A heat exchanger as claimed in claim 1, wherein the heat transfer region has an approximately square shape and the duct regions have an approximately circular circumferential edge, so that the inlet openings and outlet openings have an approximately semioval cross-sectional shape.

17. A heat exchanger as claimed in claim 1, further comprising deep-drawn turbulators integrated into the plates.

18. A heat exchanger of the crosscurrent type, through which at least two fluids flow, comprising;

a plurality of pairs of plates that are stacked one on the other between two cover plates, the plates of each pair being spaced from one another in a first region and being in contact in a second region, so that fluid paths are formed between them in a heat transfer region;

each pair of plates including inlet ducts and outlet ducts arranged laterally in duct regions and formed from inlet duct openings and outlet duct openings in the plates, at least one inlet duct and one outlet duct in a first pair of plates being fluidically connected to a group of fluid paths formed between a third pair of plates separated from the first pair of plates by a second pair of plates;

wherein the spacing of the plates in each pair is achieved by means of shaped-out portions of the plates; and further comprising deep-drawn turbulators integrated into the plates, wherein the turbulators are in the form of winglets.

19. A heat exchanger as claimed in claim 17, wherein the turbulators project into the respective fluid paths over a turbulator height which is smaller than the fluid path height of the respective fluid path.

20. A heat exchanger of the crosscurrent type, through which at least two fluids flow, comprising;

a plurality of pairs of plates that are stacked one on the other between two cover plates, the plates of each pair being spaced from one another in a first region and being in contact in a second region, so that fluid paths are formed between them in a heat transfer region;

each pair of plates including inlet ducts and outlet ducts arranged laterally in duct regions and formed from inlet duct openings and outlet duct openings in the plates, at least one inlet duct and one outlet duct in a first pair of plates being fluidically connected to a group of fluid paths formed between a third pair of plates separated from the first pair of plates by a second pair of plates;

wherein the spacing of the plates in each pair is achieved by means of shaped-out portions of the plates; and wherein the plates of the first and third pairs are spaced farther apart than the plates of the intermediate second pair in order to receive corrugated fins.

21. A heat exchanger as claimed in claim 20, wherein the spacing is produced by corrugated fin bosses have a boss height of 0.5 mm to 4 mm.

22. A heat exchanger as claimed in claim 20, wherein the corrugated fins have cutouts which are arranged to match the arrangement of the corrugated-fin bosses, in such a way that the corrugated-fin bosses are in contact through these cutouts and therefore through the corrugated fins.

23. A heat exchanger as claimed in claim 22, wherein the corrugated-fin sheets are provided with boss cutouts prior to corrugation.

24. A heat exchanger as claimed in claim 1, wherein the plates comprise aluminum, copper or high-grade steel.

25. A heat exchanger as claimed in claim 24, wherein the plates are connected by soldering.

26. A heat exchanger as claimed in claim 24, wherein the high-grade steel components are connected by welding.

27. A heat exchanger as claimed in claim 1, wherein the plates comprise plastic.

28. A heat exchanger as claimed in claim 27, wherein the plates are connected by adhesive bonding.

29. A heat exchanger as claimed in claim 2, which is braced mechanically by means of at least some of the bosses of plates adjacent to one another being welded together to act as ties.

30. A heat exchanger as claimed in claim 1, further comprising corrugated fins comprised of thoroughly oxidized aluminum.

31. A heat exchanger as claimed in claim 1, wherein a first group of fluid paths functions as reaction ducts and a second group of fluid paths functions as reaction ducts or as heat exchange ducts, the plates which form the reaction ducts being provided at least partially with a catalyst coating on their sides facing the reaction ducts.

32. A heat exchanger as claimed in claim 31, wherein the catalyst coating is formed by the micropore-generating anodic oxidation of the plates and the subsequent application of the catalyst material to the plates thus oxidized.

33. A heat exchanger as claimed in claim 1, further comprising corrugated fins covered with a wash coat.

* * * * *